United States Patent [19]

Friedl

[11] Patent Number: 4,535,708

[45] Date of Patent: Aug. 20, 1985

[54] HOT BULB IGNITION HEAD FOR A DEVICE FOR FIRING ROUGH CERAMICS, PARTICULARLY BRICKS

[76] Inventor: Andreas Friedl, Marienberger Str. 27, D-8263 Burghausen, Fed. Rep. of Germany

[21] Appl. No.: 606,848

[22] PCT Filed: Jun. 22, 1982

[86] PCT No.: PCT/DE82/00132

§ 371 Date: Sep. 30, 1982

§ 102(e) Date: Sep. 30, 1982

[87] PCT Pub. No.: WO83/00209

PCT Pub. Date: Jan. 20, 1983

Related U.S. Application Data

[63] Continuation of Ser. No. 433,127, Sep. 30, 1982, abandoned.

[30] Foreign Application Priority Data

Jun. 29, 1981 [DE] Fed. Rep. of Germany ... 8118921[U]

[51] Int. Cl.[3] ..... F23D 1/00

[52] U.S. Cl. ..... 110/265; 122/367 C; 110/256; 110/253

[58] Field of Search ..... 122/4 D, 367; 110/260–265, 253, 256

[56] References Cited

U.S. PATENT DOCUMENTS

| | | | |
|---|---|---|---|
| 669,738 | 3/1901 | Thomson | 122/367 C |
| 1,093,356 | 4/1914 | Prescott | 110/253 |
| 1,307,365 | 6/1919 | Kinyon | 110/265 |
| 1,617,601 | 2/1927 | Kitzeman | 122/367 C |
| 1,693,043 | 11/1928 | Murray | 122/367 C |
| 2,032,809 | 3/1936 | Nicol | 110/256 |
| 2,348,901 | 5/1944 | Handley | 122/367 C |
| 2,545,625 | 3/1951 | McKinley | 110/253 |
| 2,971,480 | 2/1961 | Sage | 110/265 |
| 3,110,300 | 11/1963 | Brown et al. | 122/4 D |
| 4,055,165 | 10/1977 | Scragg et al. | 110/367 C |
| 4,210,087 | 7/1980 | Melan et al. | 110/256 |
| 4,306,506 | 12/1981 | Rotter | 110/256 |
| 4,333,405 | 6/1982 | Michelfelder et al. | 110/265 |
| 4,366,778 | 1/1983 | Charrier et al. | 122/367 C |

FOREIGN PATENT DOCUMENTS

| | | |
|---|---|---|
| 707947 | 5/1941 | Fed. Rep. of Germany . |
| 1516877 | 7/1978 | United Kingdom . |

*Primary Examiner*—Henry C. Yuen

*Attorney, Agent, or Firm*—Flynn, Thiel, Boutell & Tanis

[57] ABSTRACT

A hot bulb ignition head for a device for firing rough ceramics, particularly bricks, serves the intermittent delivery of solid fuel by using compressed air. An explosion takes place in the hot ignition head, which leads to the ejection of the granular solid fuels, particularly coal, into the kiln chamber. It includes a cylindrical head portion with a baffle plate at the outlet end which forms outlet openings. The size of the outlet openings can be adapted to different kiln conditions by insertion pieces.

10 Claims, 6 Drawing Figures

HOT BULB IGNITION HEAD FOR A DEVICE FOR FIRING ROUGH CERAMICS, PARTICULARLY BRICKS

This application is a continuation of U.S. Ser. No. 433,127, filed Sept. 30, 1982, abandoned.

FIELD OF THE INVENTION

This invention relates to a hot bulb ignition head for a device for firing rough ceramics, particularly bricks, including a connecting tube for the intermittent delivery of solid fuel by compressed air, a cylindrical tube end portion of greater diameter which is connected fixedly to the connecting tube, and a baffle plate at the outlet end which forms at least two outlet openings.

BACKGROUND OF THE INVENTION

Such a hot bulb ignition head is already known from German Pat. No. 24 41 680 (which corresponds to British Pat. No. 1 516 877). In this conventional hot bulb ignition head, the distribution of the ejected solid fuel in only one specific direction does not exist. Also the danger of the destruction of the hot bulb ignition head by the occurrence of explosions is not entirely excluded and, finally, adapting the fuel distribution to different kiln conditions is not possible.

A basic purpose of the invention is to improve the conventional hot bulb ignition head so that the danger of destruction or damage of the hot bulb ignition head by explosions is avoided, better fuel ejection in the desired directions occurs, and favorable adaptation to different kiln dimensions and firing conditions is possible in a simple manner.

SUMMARY OF THE INVENTION

This purpose is attained by providing a hot ignition head which includes a connecting tube for the intermittent delivery of solid fuel by compressed air, a cylindrical tube end portion of greater diameter which is fixedly connected to the connecting tube, and a baffle plate at the outlet end of the tube end portion which forms at least two outlet openings. Two opposed, flat plates are secured in the tube end portion parallel to the longitudinal axis thereof and are connected to the baffle plate at the end of the tube end portion so as to create back-pressure chambers between the plates and the tube end portion.

Due to the hot bulb ignition head being equipped with back-pressure chambers, relatively strong explosions can be controlled without any danger. The opposed outlet openings with their guide surfaces and guide chambers assure a more accurately aimed ejection of the granulated solid fuel. Finally the insertion pieces permit a simple and quick adapting of the firing process to varying firing conditions, such as oven cross sections and the like. Furthermore, the igniting areas for the fuel are considerably enlarged, so that a more effective explosion can be achieved.

BRIEF DESCRIPTION OF THE DRAWINGS

The invention will be discussed in greater detail hereinafter in connection with an exemplary embodiment which is illustrated in the drawings, in which.

DETAILED DESCRIPTION

Figure 1:
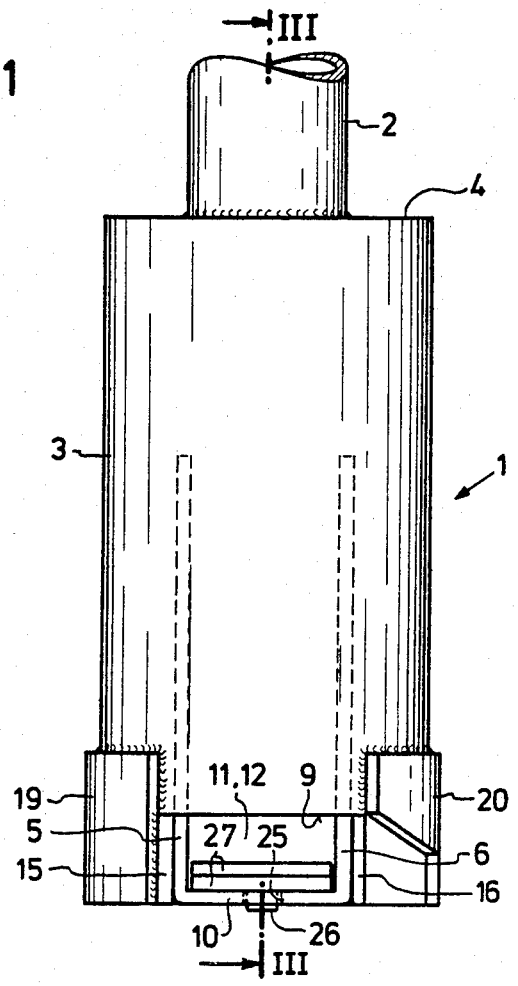
FIG. 1 is a side view of a hot bulb ignition head for a device for firing rough ceramics, particularly bricks.

The hot bulb ignition head 1 which is illustrated in FIG. 1 has a cylindrical connecting tube or conduit 2 through which the hot bulb ignition head can be connected to a feed device which intermittently supplies the hot ignition head, which is inside of a kiln, with solid fuel for example in the form of granular coal, using compressed air. The amounts of fuel and compressed air delivered are measured so that an explosion occurs in the hot bulb ignition head, by which the solid fuel particles are ejected from the hot bulb ignition head and distributed over the kiln cross section.

An elongate, hollow body member, here a cylindrical tube end portion 3, is fixedly connected to the connecting tube 2, the inside diameter of the tube end portion 3 being larger than the inside diameter of the connecting tube 2. The tube end portion 3 is welded at its upper end to the connecting tube 2, if necessary by inserting a front flange 4.

Figure 2:
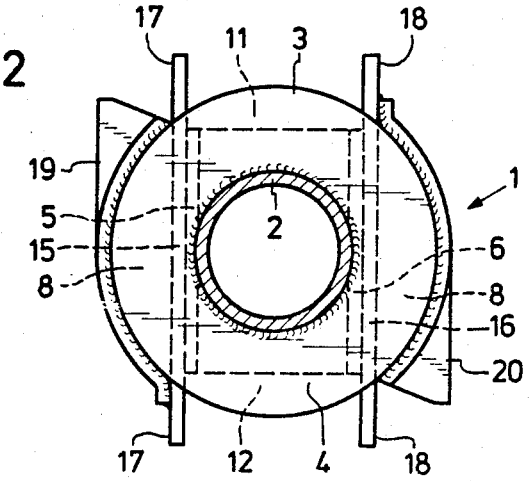
FIG. 2 is a top view of the ignition head of FIG. 1.

Two plane, side plates 5, 6 which face one another are fixedly connected to the inside wall of the tube end portion 3. As shown in FIG. 2, the side plates 5, 6 extend on a chord to the cylindrical tube end portion 3. For this purpose, the longitudinal edges 7 of the side plates 5, 6 are welded to the inside wall of the tube end portion 3. Back pressure chambers 8 are formed between the side plates 5, 6 and the inside wall of the tube end portion 3, which chambers 8 open toward the end of the connecting tube 2 and communicate with the central chamber part of the tube end portion 3.

The side plates 5, 6 project toward the outlet end of the tube end portion 3 past the lower edge 9 thereof and support a transversely extending baffle plate 10. The side plates 5, 6 and baffle plate 10 are preferably formed by a single U-shaped part.

The baffle plate 10 and side plates 5, 6 form, together with the tube end portion 3, laterally opposed outlet openings 11, 12.

Figure 3:
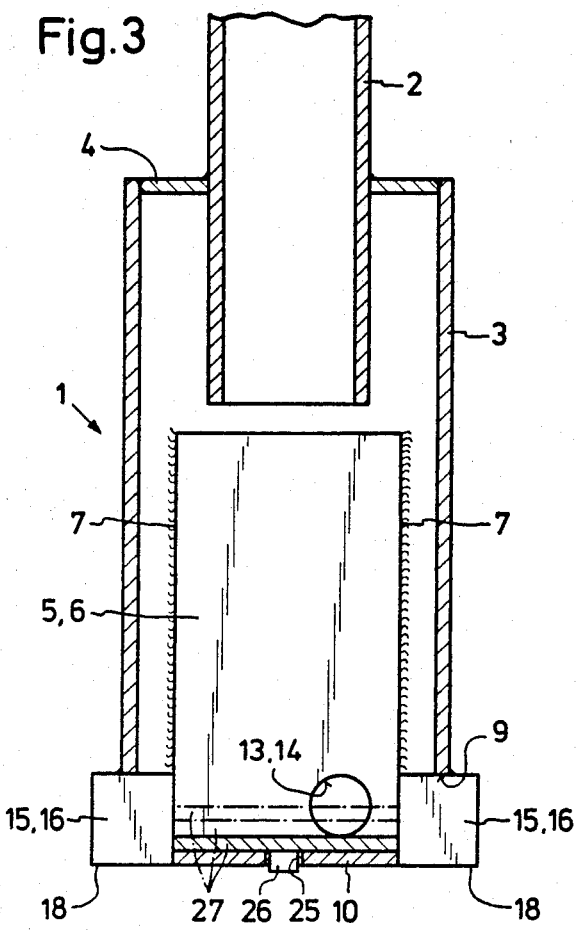
FIG. 3 is a cross sectional view taken along the line III—III of FIG. 1.
Figure 5:
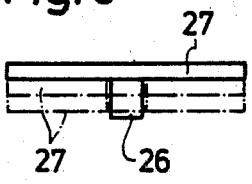
FIG. 5 is a side view of an insertion piece for a baffle plate which is a component of the head of FIG. 1.
Figure 6:
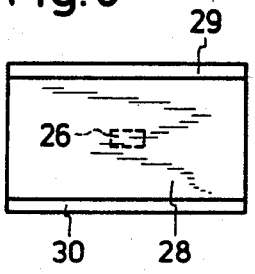
FIG. 6 is a top view of a different insertion piece.
Figure 4:
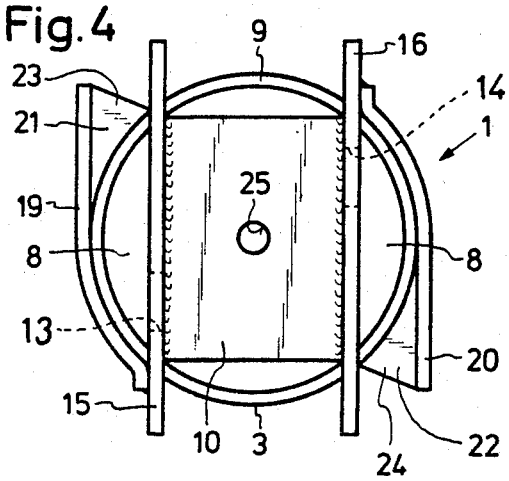
FIG. 4 is a bottom view of the hot ignition head of FIG. 1.

The side plates 5, 6 which project past the edge 9 each have a passageway or an orifice 13, 14 (FIGS. 3 and 4) offset relative to each other and to a longitudinal central plane of the tube end portion 3.

Crossbars 15, 16 which extend transversely to the longitudinal axis of the tube and which also have the passageways or orifices 13, 14 are secured to the projecting ends of the side plates 5, 6. The crossbar ends 17, 18 project preferably equally beyond both edges of the plates 5, 6 and the equally wide baffle plate 10. They thus form lateral boundaries of and guide surfaces for the outlet openings 11, 12.

Opposed guide plates 19, 20 are secured to the lower edge 9 of the tube end portion 3. The portion of these plates which projects to the level of the baffle plate 10 is curved. A longitudinal edge of each guide plate, which edges are displaced with respect to one another, is welded to a respective crossbar 15, 16, while the opposite edges are spaced from the crossbars 15, 16. For fuel particles and gases or compressed air entering guide chambers 21, 22 through the outlet openings 13, 14 the guide chambers 21, 22 open downwardly and toward opposed sides through the outlet openings 23, 24. Thus, the fuel can be distributed through the center kiln region. The guide chambers 21, 22 also communicate upwardly with the chambers 8.

The baffle-plate 10 has a central opening 25, into which can be inserted a flat locking pin 26 provided on an insertion plate 27 or a U-shaped insertion piece 28. Plural stacked plates 27 or the U-shaped insertion piece 28 fit between the side plates 5, 6 and their ends project beyond the baffle plate 10. By inserting one or more stacked plate-shaped insertion pieces 27, the outlet openings 11, 12, 13 and 14 can be varied in size. With this, an adapting of the fuel distribution to varying kiln dimensions or firing conditions is possible. The effective cross section of the orifices 13, 14 can also be varied with the U-shaped insertion piece 28 by means of the height of the laterally turned-up edges 29, 30. U-shaped and plate-shaped insertion pieces 27, 28 can also be used together.

The hot bulb ignition head and the insertion pieces consist of a heat-proof metal, preferably steel.

In operation, the oven in which such hot bulb ignition heads are used is initially heated to an appropriate working temperature as explained in my British Patent No. 1 516 877 mentioned above. At this temperature, the metal of the hot bulb ignition head will glow or become red hot. At this point, the introduction of granularized coal into the interior of the hot bulb ignition head will cause the granularized coal to become heated and, in the process of being heated to a glowing state, give off a gas. This gas will mix with the air driving the incoming coal into the hot bulb ignition head and, due to the presence of the glowing coals, create an explosion within the hot bulb ignition head. The resulting pressure wave in the chamber will generate a strong swirling of the hot air therein as well as the coal particles that have not turned completely into ash as yet. Thus, a very uniform distribution of burning coal granules and the hot air generated thereby is created and results in a uniform firing of the temperature of the oven at the working temperature. The explosive forces are controlled by the swirling air and ignited particles moving into the back-pressure chambers and thence into the chambers 21, 22 and to the outlet openings 23, 24. The effective size of the openings 13, 14 is controllable by use of the aforesaid insertion plates 27 and 28.

The embodiments of the invention in which an exclusive property or privilege is claimed are defined as follows:

1. A hot bulb ignition head adapted for receiving therein a solid fuel, comprising:

an elongate hollow body member of finite length and defining a central chamber therein;

an elongate hollow connecting conduit connected to one end of said hollow body member and for the intermittent delivery of solid fuel by compressed air, the interior of said connecting conduit being in open communication with said central chamber, said hollow body member having a larger diameter than said connecting conduit;

a pair of side plates oppositely disposed in said hollow body member and secured to the interior wall of said hollow body member along lateral edges thereof extending coextensively with the longitudinal axis of said hollow body member, said side plates extending beyond the other end of said hollow body member remote from said connecting conduit, the terminal ends of said side plates terminating externally of said hollow body member, each said side plate between said lateral edges thereof being spaced from said interior wall of said hollow body member to define a back-pressure chamber which opens outwardly of said hollow body member at said other end; and a baffle plate secured to and extending between the terminal ends of said side plates located externally of said hollow body member, the mutually adjacent edges of said baffle plate, said side plates and said hollow body member defining oppositely and radially facing first openings between said central chamber and the exterior of said hollow body member.

2. The hot bulb ignition head according to claim 1, including means defining a radially facing second opening in each said side plate on the portion thereof external of said hollow body member; and a pair of opposed guide plates secured to said hollow body member and extending in a radially spaced relation into radial alignment with said second openings to define a pair of guide chambers each contiguous with a said back-pressure chamber to deflect ignited fuel as it exits said ignition head.

3. The hot bulb ignition head according to claim 2, wherein said side plates and said baffle plate are portions of a single U-shaped piece.

4. The hot bulb ignition head according to claim 2, wherein plate-shaped crossbars are secured to the portion of said side plates projecting from said hollow body member, the projecting ends of said crossbars forming, together with said guide plates, said guide chambers.

5. The hot bulb ignition head according to claim 2, including at least one insertion piece and mounting means for accommodating a mounting of said insertion piece on said baffle plate, said insertion piece, when mounted on said baffle plate, blocking a portion of said first and second openings.

6. The hot bulb ignition head according to claim 5, wherein said mounting means comprises a central opening in said baffle plate and said insertion piece has a locking pin receivable in said central opening.

7. The hot bulb ignition head according to claim 5, wherein said insertion piece is U-shaped in cross section, the legs of the U, when said insertion piece is mounted on said baffle plate, blocking a portion of said second openings.

8. The hot bulb ignition head according to claim 5, including plural insertion pieces, each having stacking means thereon enabling a stacking of said plural insertion pieces one on top of the other to block a greater portion of said first and second openings.

9. The hot bulb ignition head according to claim 1, wherein said hollow body member is cylindrical in shape.

10. The hot bulb ignition head according to claim 9, where said side plates are each secured on a chord to the interior of said hollow body member.

* * * * *